US005150163A

United States Patent [19]

Durland et al.

[11] Patent Number: 5,150,163

[45] Date of Patent: Sep. 22, 1992

[54] SHEET TRANSPORT SYSTEM WITH IMPROVED RELEASE MECHANISM

[75] Inventors: Scott C. Durland, Rochester; James R. Cassano, Penfield; Richard M. Dastin, Fairport; Dan F. Lockwood, Ontario; Roger M. Swanson, Fairport; Robert J. Tanniscoli, Webster, all of N.Y.

[73] Assignee: Xerox Corporation, Stamford, Conn.

[21] Appl. No.: 704,151

[22] Filed: May 22, 1991

[51] Int. Cl.[5] ..... G03G 15/00

[52] U.S. Cl. ..... 355/271; 355/315; 271/308

[58] Field of Search ..... 355/315, 309, 271, 326, 355/327; 271/308, 900

[56] References Cited

U.S. PATENT DOCUMENTS

| | | | |
|---|---|---|---|
| 3,567,213 | 3/1971 | Lagonegro et al. | 271/3 |
| 3,999,987 | 12/1976 | Davis et al. | 96/1.2 |
| 4,068,939 | 1/1978 | Mailloux | 355/4 |
| 4,970,562 | 11/1990 | Birnbaum et al. | 355/327 |

FOREIGN PATENT DOCUMENTS

| | | | |
|---|---|---|---|
| 60-14267 | 1/1985 | Japan | 355/271 |

*Primary Examiner*—Joan H. Pendegrass
*Attorney, Agent, or Firm*—Paul J. Maginot

[57] ABSTRACT

A sheet transport system having a sheet release mechanism to effect release of a sheet from the sheet transport system at a point near the end of the transfer process. The sheet release mechanism includes a member positionable at a first fixed position spaced apart from the path of the sheet and a second fixed position within the path of the sheet. The sheet release mechanism is located on the side of the sheet opposite the side to which the toner image is transferred.

17 Claims, 8 Drawing Sheets

SHEET TRANSPORT SYSTEM WITH IMPROVED RELEASE MECHANISM

This invention relates generally to an electrophotographic printing machine, and more particularly concerns a sheet transport for moving a sheet in a path to enable a toner image to be transferred thereto. The invention also particularly concerns a sheet transport for moving a sheet in a recirculating path to enable successive toner images to be transferred thereto in superimposed registration with one another.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a toner image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray through a path internal the electrophotographic printing machine including a transfer station where a toner image is transferred to the copy sheet and a fuser station where the toner image is permanently affixed to the copy sheet. Finally, the copy sheet having the fused toner image thereon is transported to an output catch tray for subsequent removal therefrom by the machine operator. In the process of multi-color printing, the copy sheet moves from an input tray through a recirculating path internal the printing machine including a transfer station where a plurality of toner images are transferred to the copy sheet and a fuser station where the toner images are permanently affixed to the copy sheet. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

In both of the above processes of printing, a portion of the sheet becomes tacked to the photoconductive member during the transfer process. At the same time, the leading portion of the sheet remains gripped by the sheet gripper. At a point near the end of the transfer process, the sheet gripper releases its grip to allow the sheet to be conveyed to the fuser station. However, since the photoconductive member is moving at the same speed or slightly faster than the sheet gripper and the trailing portion of the sheet remains tacked to and thus driven by the moving photoconductive member, the leading portion of the sheet remains within the nip of the sheet gripper thereby interfering with conveyance of the sheet to the fuser station.

To address this problem, some sheet transport systems have been designed with a projection which moves along with the sheet transport to push the leading edge of the sheet out of the nip of the sheet transport at a specified time to allow the sheet to be guided toward the fuser station by a stripping mechanism positioned above the sheet transport. It would be desirable to provide a sheet transport system with a copy sheet release mechanism which has a reduced number of parts. Also, it would be desirable if such a mechanism could be provided which has its components positioned so as to consume less space internal to the machine.

The following disclosures may be relevant to various aspects of the present invention:

U.S. Pat. No. 3,567,213;
Patentee: Lagonegro et al;
Issued: Mar. 2, 1971.
U.S. Pat. No. 3,999,987;
Patentee: Davis et al;
Issued: Dec. 28, 1976.
U.S. Pat. No. 4,068,939;
Patentee: Mailloux;
Issued: Jan. 17, 1978.

The relevant portions of the foregoing disclosures may be briefly summarized as follows:

U.S. Pat. No. 3,567,213 discloses a reproduction system having a transfer drum for conveying a copy sheet. After making a plurality of revolutions on the transfer drum, the copy sheet is stripped from the surface of the transfer drum by a set of stripping fingers and then conveyed to a fusing apparatus.

U.S. Pat. No. 3,999,987 describes a printing machine having a drum for transporting a copy sheet in a recirculating path. The drum includes a projection and a set of stripout fingers. After the copy sheet is transported a desired number of revolutions on the drum, the projection moves the leading edge portion of the copy sheet away from the drum to position the copy sheet to be stripped by the stripout fingers thereby removing the sheet from the drum as continued rotation thereof is made.

U.S. Pat. No. 4,068,939 describes a electrophotographic printing machine having a rotatable transfer roll for transporting a sheet of support material in a recirculating path. After the requisite number of powder images have been transferred to the support material, the transfer roll releases the support material and spaces it from the transfer roll. A stripper bar is then interposed therebetween to separate the support material from the transfer roll. Thereafter, an endless belt conveyor advances the support material to a fixing station.

In accordance with one aspect of the present invention, there is provided an apparatus for advancing a sheet in a predetermined path through a transfer zone and into registration with information on a moving member. The apparatus comprises means for advancing the sheet through the transfer zone so that the information on the moving member is transferred to the sheet on one side thereof. The apparatus further comprises means, positioned on the side of the sheet opposite the information, for effecting release of the sheet from the advancing means, wherein the release effecting means is positionable at a first fixed position spaced apart from the path of the sheet and at a second fixed position within the path of the sheet.

Pursuant to another aspect of the present invention, there is provided a printing machine of the type having a toner image developed on a moving member with a sheet being advanced in a predetermined path through a transfer zone and into registration with the toner image. The printing machine comprises means for advancing the sheet through the transfer zone so that the toner image is transferred to the sheet on one side thereof. The printing machine further comprises means, positioned on the side of the sheet opposite the toner image, for effecting release of the sheet from the advancing means, wherein the release effecting means is positionable at a first fixed position spaced apart from the path of the sheet and at a second fixed position within the path of the sheet.

Other features of the present invention will become apparent as the following description proceeds and upon reference to the drawings, in which.

Figure 1:
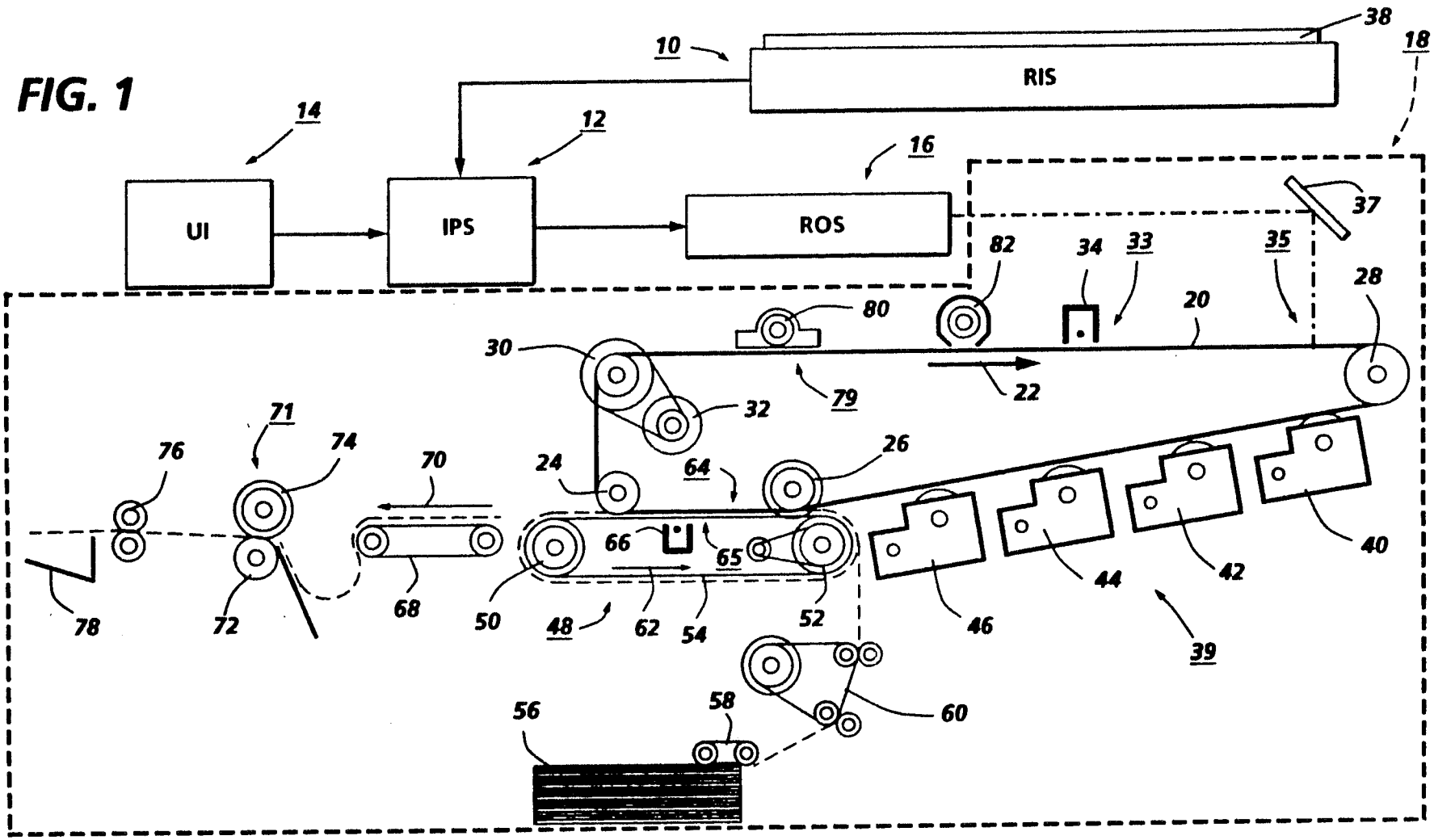
FIG. 1 is a schematic elevational view showing an electrophotographic printing machine incorporating the features of the present invention therein.
Figure 8:
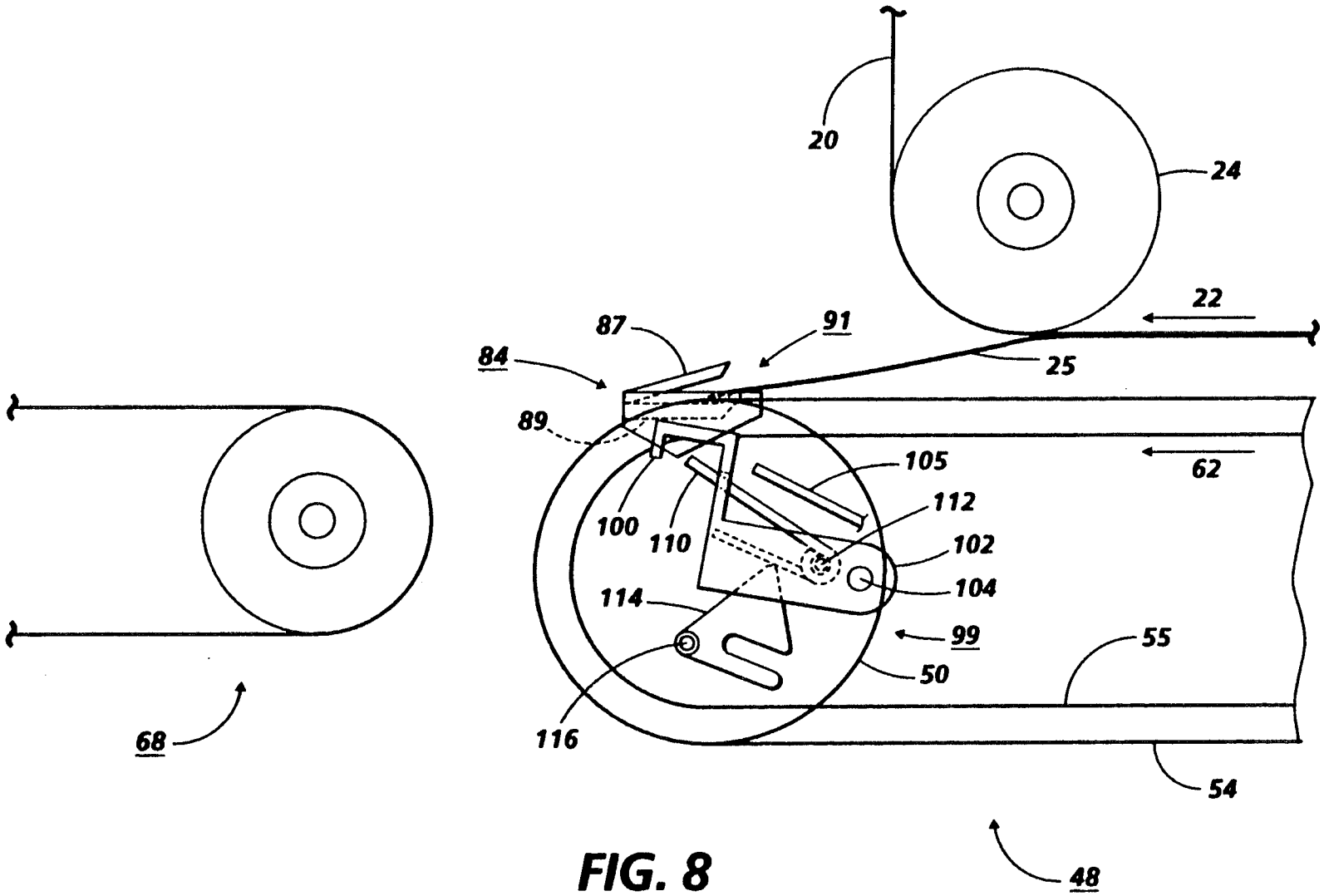
Figure 9:
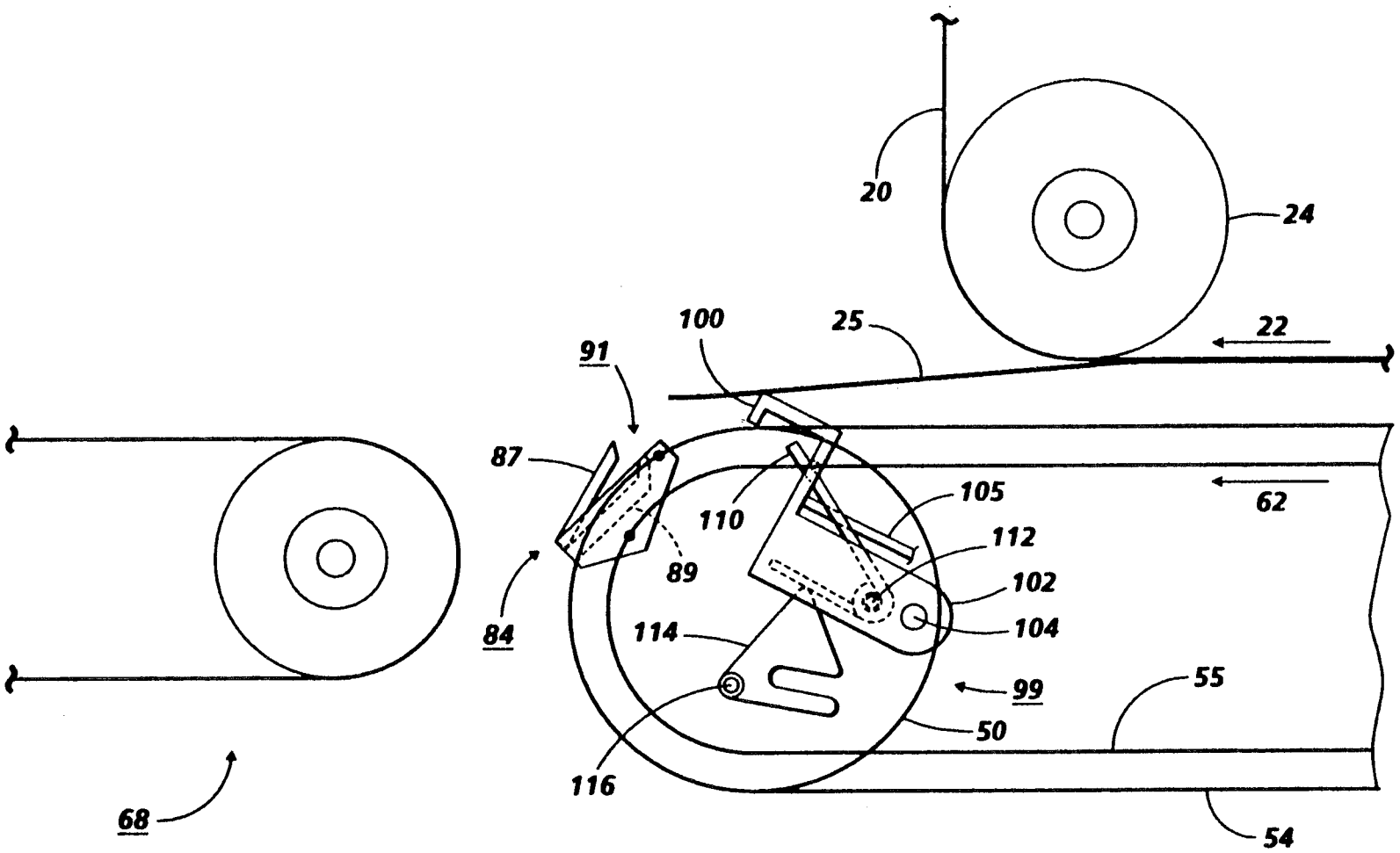

FIG. 8 is a schematic elevational view of the sheet gripper and the sheet release mechanism of the sheet transport system used in the electrophotographic printing machine of FIG. 1 with the sheet gripper shown in contact with the baffle of the sheet release mechanism; and FIG. 9 is a schematic elevational view of the sheet gripper and the sheet release mechanism of the sheet transport system used in the electrophotographic printing machine of FIG. 1 with the sheet gripper shown subsequent to contact with the baffle of the sheet release mechanism and the sheet shown effectively released from the sheet gripper.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. FIG. 1 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This formation is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magneta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper, generally indicated by the reference numeral 84 (see FIG. 3–4), extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. Further details of the sheet transport system will be discussed hereinafter with reference to FIGS. 2–9. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
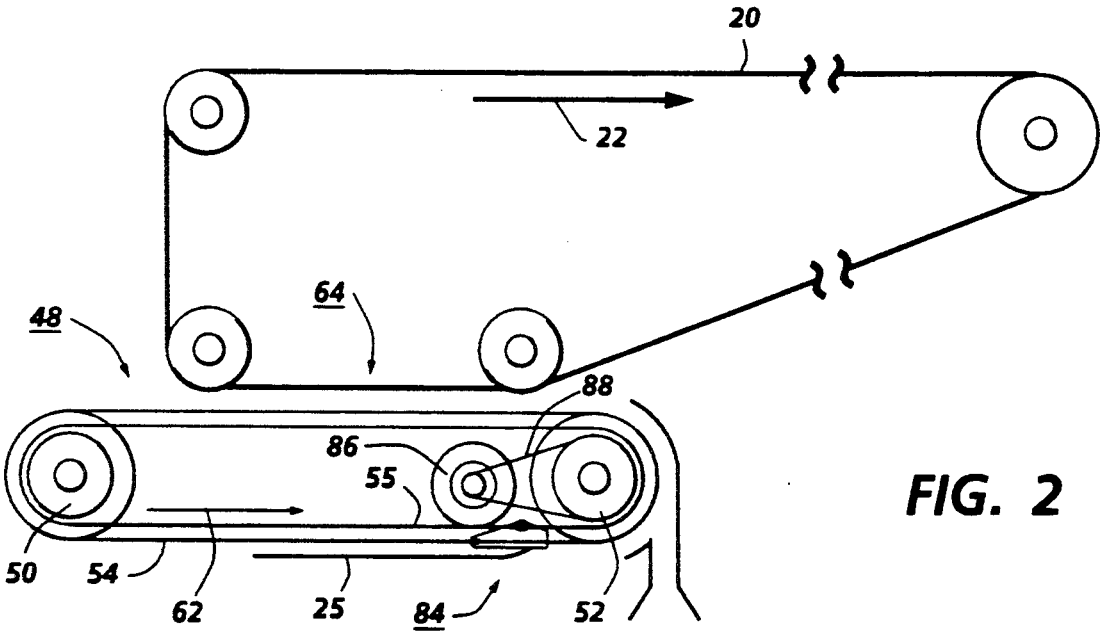
FIG. 2 is a schematic elevational view showing further details of the sheet transport system used in the electrophotographic printing machine of FIG. 1.
Figure 3:
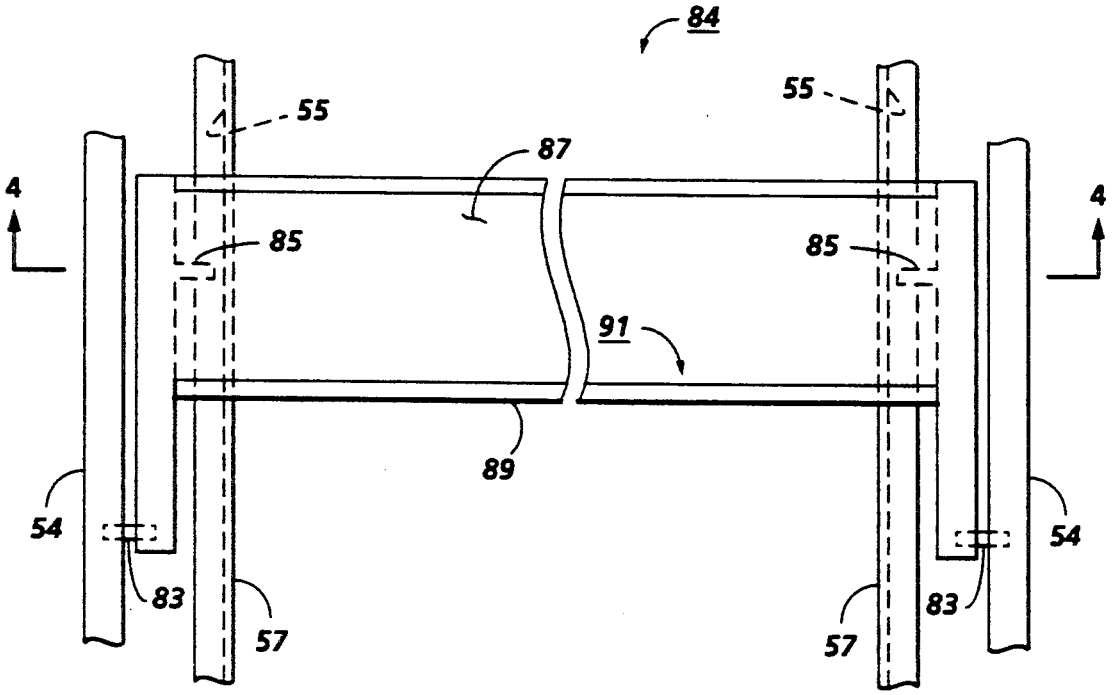
FIG. 3 is a schematic planar view showing the sheet gripper of the sheet transport system used in the electrophotographic printing machine of FIG. 1.
Figure 4:
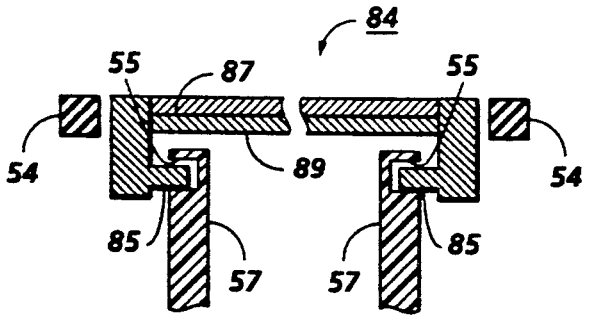
FIG. 4 is a sectional elevational view taken in the direction of arrows 4—4 in FIG. 3 of the opposed side marginal regions of the sheet gripper.

FIG. 2 shows sheet gripper 84 of sheet transport 48 transporting sheet 25 in the direction of arrow 62 in a recirculating path of movement. FIG. 3 shows sheet gripper 84 suspended between two spaced apart timing belts 54. FIG. 4 shows a sectional elevational view of the opposed side marginal regions of sheet gripper 84. Referring to FIGS. 2–4, timing belts 54 are mounted on rollers 50 and 52. Belts 54 define a continuous path of movement of sheet grippr 84. A motor 86 is coupled to roller 52 by a drive belt 88. Sheet gripper 84 includes a pair of guide members 85. A pair of spaced apart and continous tracks 55 are respectively positioned substantially adjacent belts 54. Tracks 55 are respectively defined by a pair of track supports 57. Each of guide members 85 are slidably positioned within a respective track 55. Sheet gripper 84 further includes an upper sheet gripping portion 87 and a lower sheet gripping portion 89 which are biased toward each other by a plurality of springs (not shown). The sheet gripper further includes a pair of cam followers (not shown) which are attached to the opposed side marginal regions of upper gripping portion 87 and function with a pair of cams (not shown) to open and close the gripping portions at predetermined intervals. In the closed positon, gripping portion 87 cooperates with gripping portion 89 to grasp and securely hold the leading edge of sheet 25. The area at which the gripping portions 87 and 89 grasp sheet 25 defines a gripping nip, generally indicated by the reference numeral 91 (see FIG. 3). A silicone rubber coating (not shown) may be positioned upon lower sheet gripping portion 89, near gripping nip 91, in order to increase the frictional grip of sheet 25 between the gripping portions. Belts 54 are respectively connected to the opposed side marginal regions of sheet gripper 84 by a pair of pins 83. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected.

Figure 5:
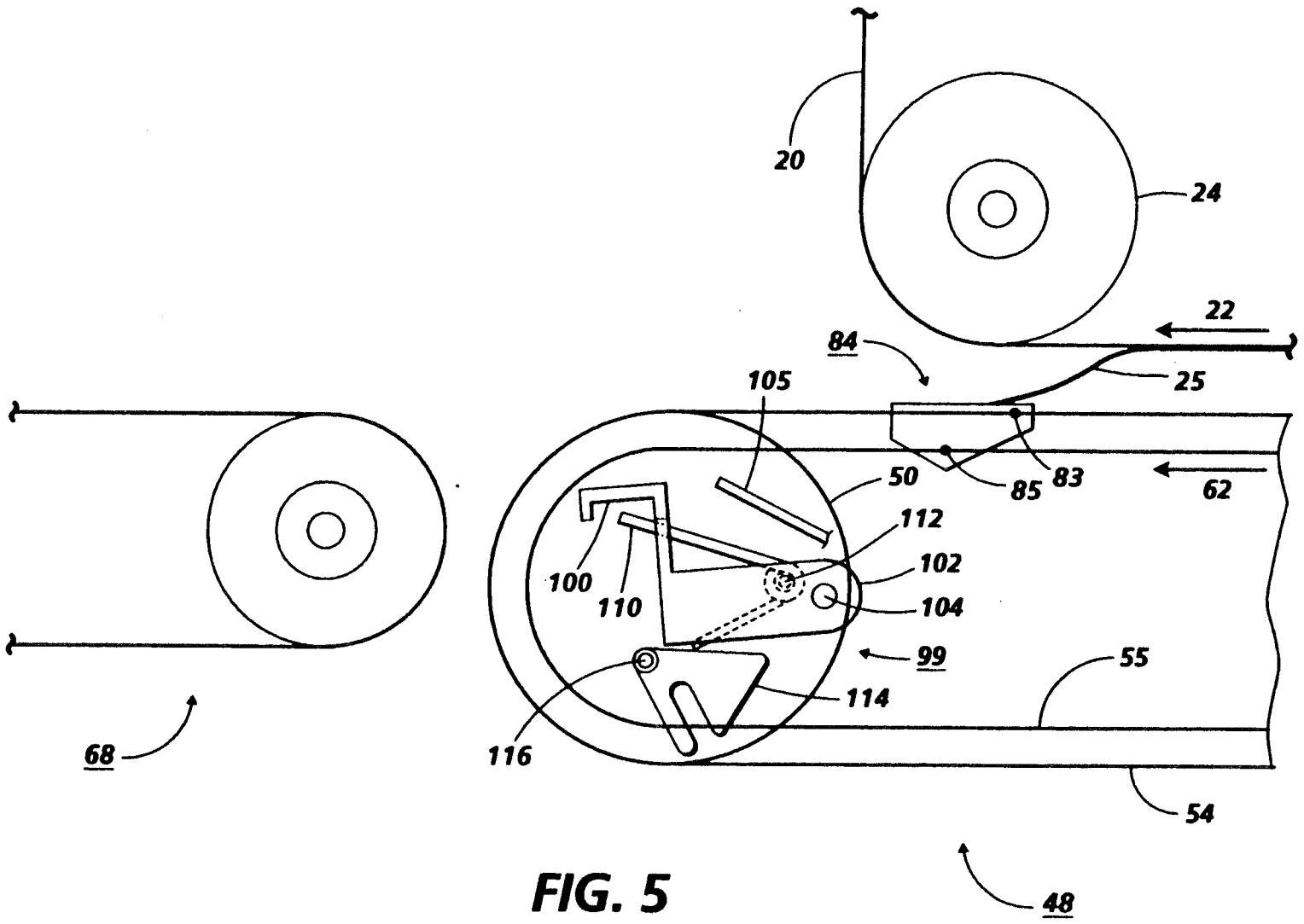
FIG. 5 is a schematic elevational view of the sheet gripper and the sheet release mechanism of the sheet transport system used in the electrophotographic printing machine of FIG. 1 with the baffle of the sheet release mechanism its first fixed position.
Figure 6:
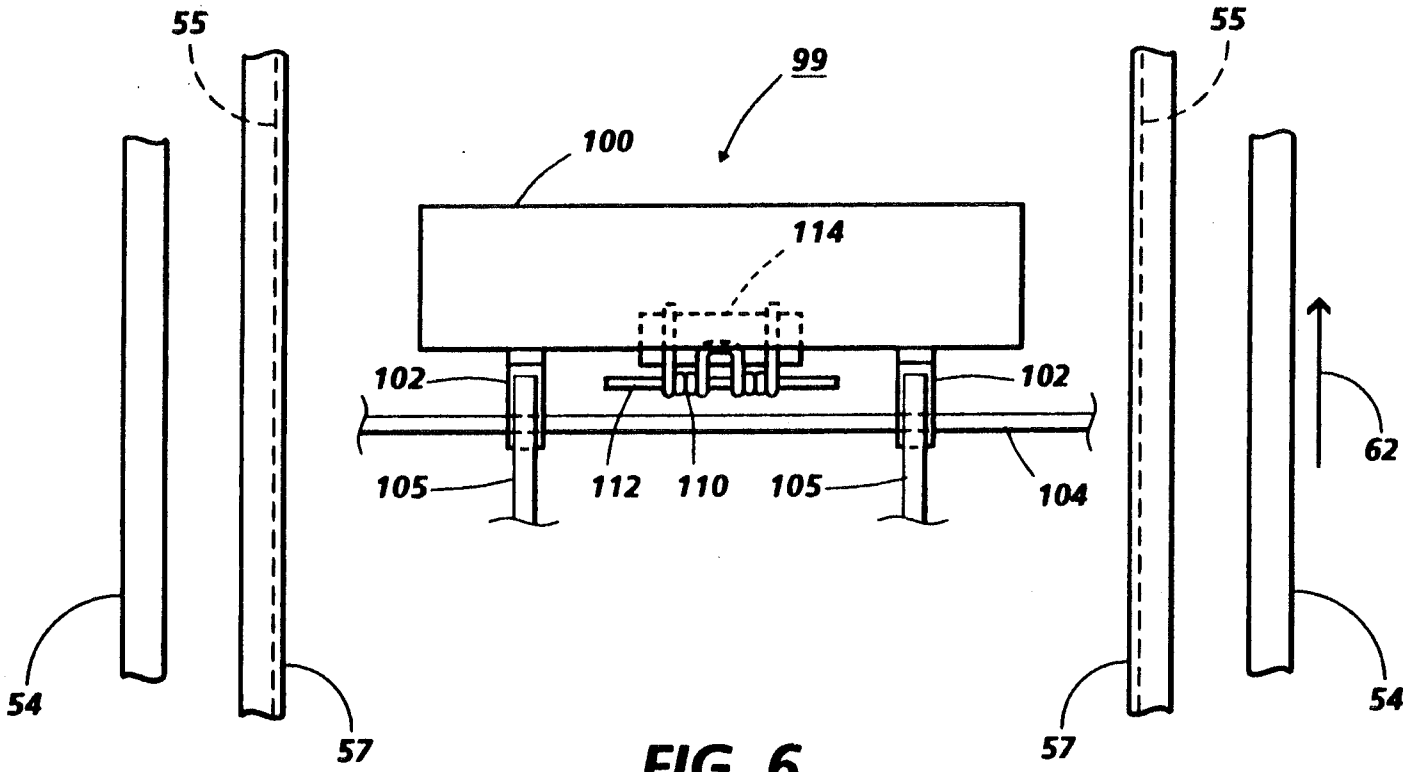
FIG. 6 is a schematic planar view showing the sheet release mechanism of the sheet transport system of FIG. 5.
Figure 7:
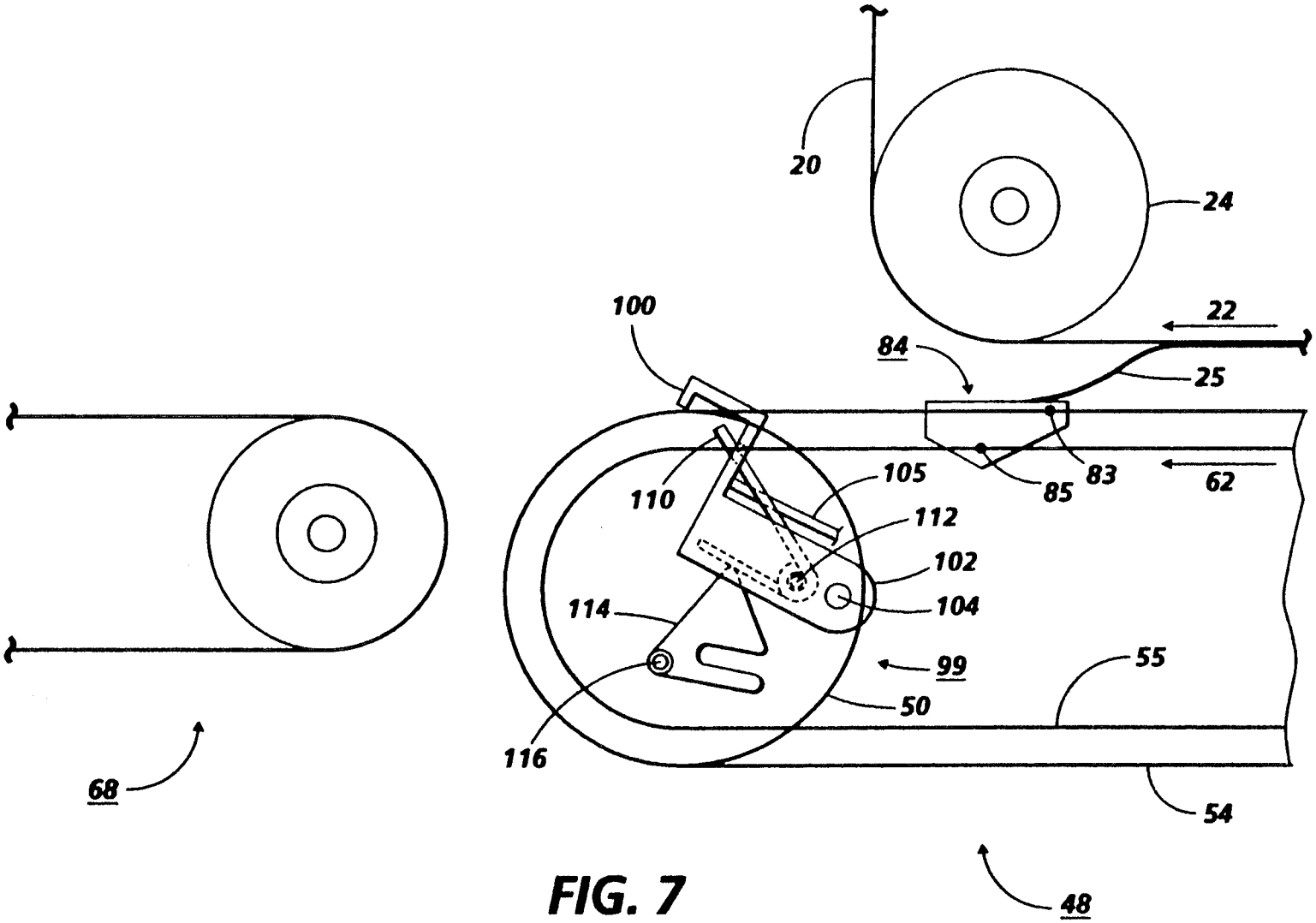
FIG. 7 is a schematic elevational view of the sheet gripper and the sheet release mechanism of the sheet transport system used in the electrophotographic printing machine of FIG. 1 with the sheet gripper shown prior to contact with the baffle of the sheet release mechanism positioned in its second fixed position.

Referring now to FIGS. 5 and 6, sheet transport apparatus 48 includes a sheet release mechanism 99 for effecting release of sheet 25 from sheet gripper 84 at a point near the end of the transfer process. Sheet release mechanism 99 includes a baffle 100 which is connected to a pair of brackets 102. Baffle 100 has a length substantially equal to the width of sheet 25. Brackets 102 are pivotally mounted on a shaft 104. As a result, baffle 100 is pivotable between a first position as shown in FIG. 5 and a second position as shown in FIG. 7. The first position and the second positon of baffle 100 are stationary or fixed since baffle 100 is not moving along with sheet gripper 48 as the sheet gripper travels throughout its entire recirculating path.

Operatively associated with baffle 100 is a spring 110 and an intermediate release link 114. Spring 110 is pivotally mounted on a shaft 112 while release link 114 is pivotally mounted on a shaft 116. Release link 114 is rotatable about shaft 116 between a first position as shown in FIG. 5 and a second position as shown in FIG. 7. When release link 114 is located at its first position, baffle 100 is correspondingly located at its first fixed position. However, when release link 114 is forced to rotate from its first position to its second position, baffle 100 is correspondingly forced to move from its first fixed position to its second fixed position. The above movement of baffle 100 is a result of force applied thereto by release link 114 which is transmitted via spring 110. Baffle 100 is prevented from moving beyond its second fixed position by a pair of stops 105. Release link 114 is driven to rotate from its first position to its second position as a result of force applied thereto by a solenoid (not shown) which is coupled to release link 114 via mechanical linkage (not shown). Release link 114 rotates from its first position to its second position in a counterclockwise manner. In both its first fixed position and its second fixed position, baffle 100 and its associated activating mechanism are located on the side of sheet 25 opposite the side to which the toner image is transferred.

FIG. 5 shows sheet release mechanism 99 with baffle 100 located in its first fixed position. At this position, baffle 100 is spaced apart from the path of sheet gripper 84 and sheet 25. Thus, as sheet gripper 84 transports sheet 25 in its recirculating path of movement, baffle 100 is positioned so as not physically contact sheet gripper 84 or sheet 25. However, at a point near the end of the transfer process, a control system (not shown) activates the solenoid thereby causing baffle 100 to assume its second fixed position. FIG. 7 shows sheet release mechanism 99 with baffle 100 located in its second fixed position. At this position, baffle 100 is located within the path of sheet gripper 84 and sheet 25. Therefore, as sheet gripper 84 transports sheet 25 in its path of movement, baffle 100 is positioned to physically contact sheet gripper 84 and sheet 25. In FIG. 7, sheet gripper 84 is shown transporting sheet 25 in the direction of arrow 62 at a location in its path of movement prior to physical contact with baffle 100. Note that at this loation of the sheet gripper, a portion of sheet 25 is tacked to photoconductive belt 20.

As sheet gripper 84 continues to travel in the direction of arrow 62, lower gripping portion 89 of sheet gripper 84 contacts baffle 100 and urges it downward against the spring bias of spring 110 as shown in FIG. 8 (see also FIG.4). At this time, upper gripping portion 87 of sheet gripper 84 is in the open position. Again, note that a portion of sheet 25 is tacked to photoconductive belt 20 at this sheet gripper location. Since sheet 25 is tacked to photoconductive belt 20 and the photoconductive belt is moving in the direction of arrow 22 at the same speed or slightly faster than sheet gripper 84, the leading portion of the sheet remains within nip 91 of sheet gripper 84.

Referring to FIG. 9, once the trailing edge of sheet gripper 84 passes over the leading edge of baffle 100, the baffle springs back to its second fixed position thereby contacting sheet 25 to force the leading portion of the sheet out of nip 91 of sheet gripper 84. Baffle 100 then functions to guide sheet 25 to vacuum transport 68. Vacuum tranport 68 then conveys sheet 25 to fuser station 71 as shown in FIG. 1.

In recapitulation, the sheet release mechanism of the present invention is used in a sheet transport system to effect release of a sheet from the sheet transport system at a point near the end of the transfer process. The sheet release mechanism includes a member positionable at a first fixed position spaced apart from the path of the sheet and at a second fixed position within the path of the sheet. The sheet release mechanism is located on the side of the sheet opposite the side to which the toner image is transferred.

It is, therefore, apparent that there has been provided in accordance with the present invention, a sheet transport system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claims:

1. An apparatus for advancing a sheet in a predetermined path through a transfer zone and into registration with information on a moving member, comprising:

means for advancing the sheet through the transfer zone so that the information on the moving member is transferred to the sheet on one side thereof; and means, positioned on the side of the sheet opposite the information, for effecting release of the sheet from said advancing means, wherein said release effecting means is positionable at a first fixed position spaced apart from the path of the sheet and at a second fixed position within the path of the sheet, the first fixed position and the second fixed position each being fixed in relation to the path of the sheet.

2. The apparatus of claim 1, wherein said release effecting means comprises a member positionable at the first position and at the second position, further wherein said member contacts the sheet near the leading portion thereof as said member travels from the first position to the second position.

3. The apparatus of claim 2, wherein said member contacts the side of the sheet opposite the information.

4. An apparatus for advancing a sheet in a predetermined path through a transfer zone and into registration with information on a moving member, comprising:

means for advancing the sheet through the transfer zone so that the information on the moving member is transferred to the sheet on one side thereof; and means, positioned on the side of the sheet opposite the information, for effecting release of the sheet from said advancing means, wherein said release effecting means is positionable at a first fixed position spaced apart from the path of the sheet and at a second fixed position within the path of the sheet, wherein said release effecting means comprises a member positionable at the first position and at the second position, further wherein said member contacts the sheet near the leading portion thereof as said member travels from the first position to the second position, and wherein said member contacts the side of the sheet opposite the information, and wherein said member substantially spans the width of the sheet.

5. The apparatus of claim 2, wherein said release effecting means further comprises a stop adapted to locate said member at the second fixed position.

6. The apparatus of claim 5, wherein said release effecting means further comprises means for the resiliently urging said member into contact with said stop.

7. The apparatus of claim 6, wherein said urging means comprises a spring.

8. The apparatus of claim 2, wherein said release effecting means further comprises means to move said member from the first position to the second position.

9. A printing machine of the type having a toner image developed on a moving member with a sheet being advanced in a predetermined path through a transfer zone and into registration with the toner image, comprising:

means for advancing the sheet through the transfer zone so that the toner image is transferred to the sheet on one side thereof; and means, positioned on the side of the sheet opposite the toner image, for effecting release of the sheet from said advancing means, wherein said release effecting means is positionable at a first fixed position spaced apart from the path of the sheet and at a second fixed position within the path of the sheet, the first fixed position and the second fixed position each being fixed in relation to the path of the sheet.

10. The printing machine of claim 9, wherein said release effecting means comprises a member positionable at the first position and at the second position, further wherein said member contacts the sheet near the leading portion thereof as said member travels from the first position to the second position.

11. The printing machine of claim 10, wherein said member contacts the side of the sheet opposite the toner image.

12. A printing machine of the type having a toner image developed on a moving member with a sheet being advanced in a predetermined path through a transfer zone and into registration with the toner image, comprising:

means for advancing the sheet through the transfer zone so that the toner image is transferred to the sheet on one side thereof; and means, positioned on the side of the sheet opposite the toner image, for effecting release of the sheet from said advancing means, wherein said release effecting means is positionable at a first fixed position spaced apart from the path of the sheet and at a second fixed position within the path of the sheet, wherein said release effecting means comprises a member positionable at the first position and at the second position, further wherein said member contacts the sheet near the leading portion thereof as said member travels from the first position to the second position, and wherein said member contacts the side of the sheet opposite the toner image, and wherein said member substantially spans the width of the sheet.

13. The printing machine of claim 10, wherein said release effecting means further comprises a stop adapted to locate said member at the second fixed position.

14. The printing machine of claim 13, wherein said release effecting means further comprises means for resiliently urging said member into contact with said stop.

15. The printing machine of claim 14, wherein said urging means comprises a spring.

16. The printing machine of claim 10, wherein said release effecting means further comprises means to move said member from the first position to the second position.

17. The printing machine of claim 9, further comprising means for sequentially developing a plurality of toner images on the moving member, each having a different color, with the sheet being advanced into registration with each of the plurality of toner images to form a multi-color image.

* * * * *